US010764970B2

(12) United States Patent
Giordano

(10) Patent No.: US 10,764,970 B2
(45) Date of Patent: Sep. 1, 2020

(54) MULTIPLE CAVITY MICROWAVE OVEN INSULATED DIVIDER

(71) Applicants: WHIRLPOOL CORPORATION, Benton Harbor, MI (US); Panasonic Corporation, Kadoma-Shi (JP)

(72) Inventor: Francesco Giordano, Cremona (IT)

(73) Assignees: Whirlpool Corporation, Benton Harbor, MI (US); Panasonic Corporation, Osaka (JP)

( * ) Notice: Subject to any disclaimer, the term of this patent is extended or adjusted under 35 U.S.C. 154(b) by 188 days.

(21) Appl. No.: 16/068,269

(22) PCT Filed: Jan. 8, 2016

(86) PCT No.: PCT/US2016/012749
§ 371 (c)(1),
(2) Date: Jul. 5, 2018

(87) PCT Pub. No.: WO2017/119910
PCT Pub. Date: Jul. 13, 2017

(65) Prior Publication Data

US 2019/0029082 A1 Jan. 24, 2019

(51) Int. Cl.
*H05B 6/64* (2006.01)
*H05B 6/80* (2006.01)
*H05B 6/46* (2006.01)

(52) U.S. Cl.
CPC ..... *H05B 6/6402* (2013.01); *H05B 6/46* (2013.01); *H05B 6/6408* (2013.01); *H05B 6/80* (2013.01)

(58) Field of Classification Search
CPC ..... H05B 6/46; H05B 6/6402; H05B 6/6408; H05B 6/6411; H05B 6/647; H05B 6/6494; H05B 6/664; H05B 6/68; H05B 6/686; H05B 6/688; H05B 6/70; H05B 6/705; H05B 6/72; H05B 6/725; H05B 6/763; H05B 6/766; H05B 6/80
USPC ..... 219/752–756, 762, 763
See application file for complete search history.

(56) References Cited

U.S. PATENT DOCUMENTS 2,742,612 A 4/1956 Cohn
2,956,143 A 10/1960 Schall
2,958,754 A 11/1960 Hahn
2,981,904 A 4/1961 Ajioka et al.
(Continued)

FOREIGN PATENT DOCUMENTS

CN 1523293 A 8/2004
CN 101118425 2/2008
(Continued)

*Primary Examiner* — Hung D Nguyen
(74) *Attorney, Agent, or Firm* — Price Heneveld LLP

(57) ABSTRACT

A radio frequency heating apparatus (100) having a cooking cavity (112) dividable into at least two sub-cavities (116, 118), a removable partition (114) for thermally insulating the at least two sub-cavities (116, 118), a rail (128) provided along a boundary of the cavity (112) for supporting the removable partition (114), and at least one radio frequency generator configured to transmit radio frequency radiation into at least one of the at least two sub-cavities (116, 118). The rail (128) is corrugated with a set of grooves or ridges (138), and a perimeter of the partition (114) is corrugated with a set of grooves or ridges (136) complementary to the grooves or ridges (138) of the rail (128).

11 Claims, 4 Drawing Sheets

(56) References Cited

U.S. PATENT DOCUMENTS 3,260,832 A 7/1966 Johnson
3,265,995 A 8/1966 Hamasaki
3,430,023 A 2/1969 Tingley
3,440,385 A 4/1969 Smith
3,489,135 A 1/1970 Astrella
3,536,129 A 10/1970 White
3,639,717 A 2/1972 Mochizuki
3,731,035 A 5/1973 Jarvis et al.
3,737,812 A 6/1973 Gaudio et al.
3,812,316 A 5/1974 Milburn
4,000,390 A 12/1976 Graff
4,088,861 A 5/1978 Zwillinger
D248,607 S 7/1978 Yamamura et al.
4,101,750 A 7/1978 Doner
4,107,502 A 8/1978 Tanaka et al.
4,136,271 A 1/1979 Tanaka et al.
4,139,828 A 2/1979 Commault et al.
4,143,646 A 3/1979 Sampsel et al.
4,166,207 A 8/1979 Burke
4,196,332 A 1/1980 MacKay et al.
4,264,800 A 4/1981 Jahnke et al.
4,283,614 A 8/1981 Tanaka et al.
4,321,445 A 3/1982 Kristof et al.
4,354,562 A 10/1982 Newman
4,374,319 A 2/1983 Guibert
D268,079 S 3/1983 Miyake et al.
4,463,324 A 7/1984 Rolfs
D275,546 S 9/1984 Tanaka et al.
D276,122 S 10/1984 Tanaka et al.
D277,355 S 1/1985 Miyake et al.
4,595,827 A 6/1986 Hirai et al.
D285,893 S 9/1986 Mizuma et al.
4,628,351 A 12/1986 Heo
4,673,800 A 6/1987 Hirai et al.
4,703,151 A 10/1987 Sakamoto
4,743,728 A 5/1988 Nagafusa et al.
D297,698 S 9/1988 Nishikawa et al.
D297,800 S 9/1988 Feil et al.
4,786,774 A 11/1988 Kaminaka
D303,063 S 8/1989 Satake
4,870,238 A 9/1989 Hodgetts et al.
4,886,046 A 12/1989 Welch et al.
4,937,413 A 6/1990 Spruytenburg et al.
4,999,459 A 3/1991 Smith et al.
5,075,525 A 12/1991 Jung
D330,144 S 10/1992 Takebata et al.
5,369,254 A 11/1994 Kwon
D353,511 S 12/1994 Saimen
5,483,045 A 1/1996 Gerling
5,546,927 A 8/1996 Lancelot
5,558,800 A 9/1996 Page
D378,723 S 4/1997 Weiss
5,619,983 A 4/1997 Smith
D385,155 S 10/1997 Weiss et al.
5,735,261 A 4/1998 Kieslinger
5,831,253 A 11/1998 Han et al.
5,878,910 A 3/1999 Gibemau et al.
D411,074 S 6/1999 Sakai et al.
5,919,389 A 7/1999 Uehashi et al.
5,928,540 A 7/1999 Antoine et al.
5,973,305 A 10/1999 Kim et al.
5,981,929 A 11/1999 Maeda et al.
6,018,158 A 1/2000 Kang
6,054,696 A 4/2000 Lewis et al.
6,057,535 A 5/2000 Derobert et al.
6,097,019 A 8/2000 Lewis et al.
6,268,593 B1 7/2001 Sakai
6,359,270 B1 3/2002 Bridson
6,429,370 B1 8/2002 Norte et al.
6,557,756 B1 5/2003 Smith
6,559,882 B1 5/2003 Kerchner
D481,582 S 11/2003 Seum et al.
6,664,523 B1 12/2003 Kim et al.
6,696,678 B2 2/2004 Hudson et al.
D495,556 S 9/2004 Milrud et al.
6,853,399 B1 2/2005 Gilman et al.
D521,799 S 5/2006 Ledingham et al.
D522,801 S 6/2006 Lee
D527,572 S 9/2006 Lee et al.
7,105,787 B2 9/2006 Clemen, Jr.
7,111,247 B2 9/2006 Choi et al.
D530,973 S 10/2006 Lee et al.
D531,447 S 11/2006 Lee et al.
D532,645 S 11/2006 Lee
7,193,195 B2 3/2007 Lundstrom et al.
D540,105 S 4/2007 Lee et al.
D540,613 S 4/2007 Jeon
D550,024 S 9/2007 Jeon
7,361,871 B2 4/2008 Cho et al.
D568,675 S 5/2008 Kawata
7,476,828 B2 1/2009 Genua
7,482,562 B2 1/2009 Song et al.
D586,619 S 2/2009 Pino et al.
D587,959 S 3/2009 Hensel
7,556,033 B2 7/2009 Kim
D602,306 S 10/2009 Lavy
7,770,985 B2 8/2010 Davis et al.
D625,557 S 10/2010 Pino et al.
D626,370 S 11/2010 Baek
7,919,735 B2 4/2011 Kiyono et al.
7,926,313 B2 4/2011 Schenkl et al.
D638,249 S 5/2011 Ryan et al.
8,074,637 B2 12/2011 Yamauchi
D655,970 S 3/2012 De'Longhi
D658,439 S 5/2012 Curtis et al.
D662,759 S 7/2012 Blacken et al.
D663,156 S 7/2012 Curtis et al.
D670,529 S 11/2012 Hensel
D673,000 S 12/2012 De'Longhi
D673,418 S 1/2013 Lee et al.
D678,711 S 3/2013 Reiner
8,389,916 B2 3/2013 Ben-Shmuel et al.
8,455,803 B2 6/2013 Danzer et al.
8,492,686 B2 7/2013 Bilchinsky et al.
8,530,807 B2 9/2013 Niklasson et al.
8,610,038 B2 12/2013 Hyde et al.
8,745,203 B2 6/2014 McCoy
8,803,051 B2 8/2014 Lee et al.
D717,579 S 11/2014 Gregory et al.
9,040,879 B2 5/2015 Libman et al.
D736,554 S 8/2015 Steiner et al.
D737,620 S 9/2015 Miller et al.
D737,622 S 9/2015 Miller et al.
9,131,543 B2 9/2015 Ben-Shmuel et al.
9,132,408 B2 9/2015 Einziger et al.
9,179,506 B2 11/2015 Sim et al.
9,210,740 B2 12/2015 Libman et al.
9,215,756 B2 12/2015 Bilchinsky et al.
9,351,347 B2 5/2016 Torres et al.
9,374,852 B2 6/2016 Bilchinsky et al.
D769,669 S 10/2016 Kim et al.
9,560,699 B2 1/2017 Zhylkov et al.
9,585,203 B2 2/2017 Sadahira et al.
2002/0060215 A1* 5/2002 Allera ..... F24C 15/325 219/394
2005/0162335 A1 7/2005 Ishii
2006/0289435 A1* 12/2006 Park ..... H05B 6/642 219/394
2006/0289526 A1 12/2006 Takizaki et al.
2009/0134155 A1 5/2009 Kim et al.
2010/0176121 A1 7/2010 Nobue et al.
2010/0176123 A1* 7/2010 Mihara ..... H05B 6/686 219/746
2010/0187224 A1 7/2010 Hyde et al.
2010/0276417 A1* 11/2010 Uchiyama ..... H05B 6/725 219/702
2011/0031236 A1 2/2011 Ben-Shmuel et al.
2011/0168699 A1 7/2011 Oomori et al.
2011/0290790 A1 12/2011 Sim et al.
2012/0067872 A1 3/2012 Libman et al.
2012/0103972 A1 5/2012 Okajima
2012/0152939 A1 6/2012 Nobue et al.
2012/0160830 A1 6/2012 Bronstering
2013/0048881 A1 2/2013 Einziger et al.

(56) References Cited

U.S. PATENT DOCUMENTS

| | | | | |
|---|---|---|---|---|
| 2013/0080098 | A1 | 3/2013 | Hadad et al. | |
| 2013/0142923 | A1 | 6/2013 | Torres et al. | |
| 2013/0153570 | A1* | 6/2013 | Carlsson | H05B 6/80 219/756 |
| 2013/0156906 | A1 | 6/2013 | Raghavan et al. | |
| 2013/0186887 | A1 | 7/2013 | Hallgren et al. | |
| 2013/0200066 | A1 | 8/2013 | Gelbart et al. | |
| 2013/0277353 | A1 | 10/2013 | Joseph et al. | |
| 2014/0197161 | A1 | 7/2014 | Dobie | |
| 2014/0203012 | A1 | 7/2014 | Corona et al. | |
| 2014/0208957 | A1 | 7/2014 | Imai et al. | |
| 2014/0277100 | A1 | 9/2014 | Kang | |
| 2015/0034632 | A1 | 2/2015 | Brill et al. | |
| 2015/0070029 | A1 | 3/2015 | Libman et al. | |
| 2015/0136758 | A1 | 5/2015 | Yoshino et al. | |
| 2015/0156827 | A1 | 6/2015 | Ibragimov et al. | |
| 2015/0173128 | A1 | 6/2015 | Hosokawa et al. | |
| 2015/0271877 | A1 | 9/2015 | Johansson | |
| 2015/0289324 | A1 | 10/2015 | Rober et al. | |
| 2015/0305095 | A1 | 10/2015 | Huang et al. | |
| 2015/0334788 | A1 | 11/2015 | Hofmann et al. | |
| 2015/0373789 | A1 | 12/2015 | Meusburger et al. | |
| 2016/0029442 | A1 | 1/2016 | Houbloss et al. | |
| 2016/0088690 | A1 | 3/2016 | Kubo et al. | |
| 2016/0119982 | A1 | 4/2016 | Kang et al. | |
| 2016/0219656 | A1 | 7/2016 | Hunter, Jr. | |
| 2016/0327281 | A1 | 11/2016 | Bhogal et al. | |
| 2016/0353528 | A1 | 12/2016 | Bilchinsky et al. | |
| 2016/0353529 | A1 | 12/2016 | Omori et al. | |
| 2017/0099988 | A1 | 4/2017 | Matloubian et al. | |
| 2017/0105572 | A1 | 4/2017 | Matloubian et al. | |
| 2017/0251529 | A2* | 8/2017 | Spagnoli | H05B 6/68 |

FOREIGN PATENT DOCUMENTS

| | | | |
|---|---|---|---|
| CN | 201081287 | Y | 7/2008 |
| CN | 102012051 | A | 4/2011 |
| CN | 102620324 | A | 8/2012 |
| CN | 103156532 | A | 6/2013 |
| CN | 203025135 | U | 6/2013 |
| CN | 105042654 | A | 11/2015 |
| CN | 204987134 | U | 1/2016 |
| CN | 106103555 | A | 11/2016 |
| DE | 3238441 | A1 | 4/1984 |
| DE | 102004002466 | A1 | 8/2005 |
| DE | 102008042467 | A1 | 4/2010 |
| EP | 0199264 | A2 | 10/1986 |
| EP | 0493623 | A1 | 8/1992 |
| EP | 1193584 | | 3/2002 |
| EP | 1424874 | A2 | 6/2004 |
| EP | 1426692 | A2 | 6/2004 |
| EP | 1471773 | A2 | 10/2004 |
| EP | 1732359 | A2 | 12/2006 |
| EP | 1795814 | | 6/2007 |
| EP | 1970631 | A2 | 9/2008 |
| EP | 2031938 | A1 | 3/2009 |
| EP | 2205043 | A1 | 7/2010 |
| EP | 2230463 | A1 | 9/2010 |
| EP | 2220913 | B1 | 5/2011 |
| EP | 2512206 | A1 | 10/2012 |
| EP | 2405711 | A2 | 11/2012 |
| EP | 2618634 | A1 | 7/2013 |
| EP | 2775794 | A1 | 9/2014 |
| EP | 2906021 | A1 | 8/2015 |
| EP | 2393339 | B1 | 12/2016 |
| FR | 2766272 | A1 | 1/1999 |
| FR | 2976651 | A | 12/2012 |
| GB | 639470 | A | 6/1950 |
| GB | 1424888 | | 2/1976 |
| GB | 2158225 | A | 11/1985 |
| GB | 2193619 | A | 2/1988 |
| GB | 2367196 | A | 3/2002 |
| JP | S55155120 | A | 12/1980 |
| JP | 57194296 | U | 12/1982 |
| JP | 59226497 | A | 12/1984 |
| JP | H0510527 | A | 1/1993 |
| JP | H06147492 | A | 5/1994 |
| JP | 8-171986 | | 7/1996 |
| JP | 2000304593 | A | 11/2000 |
| JP | 2008108491 | A | 5/2008 |
| JP | 2011146143 | A | 7/2011 |
| JP | 2013073710 | A | 4/2013 |
| KR | 2050002121 | | 7/2005 |
| KR | 101359460 | B1 | 2/2014 |
| KR | 20160093858 | A | 8/2016 |
| RU | 2122338 | C1 | 11/1998 |
| RU | 2215380 | C2 | 10/2003 |
| RU | 2003111214 | A | 11/2004 |
| RU | 2003122979 | A | 2/2005 |
| RU | 2008115817 | A | 10/2009 |
| RU | 2008137844 | A | 3/2010 |
| WO | 8807805 | A1 | 10/1988 |
| WO | 0036880 | | 6/2000 |
| WO | 02065036 | A1 | 8/2002 |
| WO | 03077601 | A1 | 9/2003 |
| WO | 2008018466 | A1 | 2/2008 |
| WO | 2008102360 | A2 | 8/2008 |
| WO | 2009039521 | A1 | 3/2009 |
| WO | 2011138680 | A2 | 11/2011 |
| WO | 2012001523 | A2 | 1/2012 |
| WO | 2012162072 | | 11/2012 |
| WO | 2011039961 | A1 | 2/2013 |
| WO | 2015024177 | A1 | 2/2015 |
| WO | 2015099648 | A1 | 7/2015 |
| WO | 2015099650 | A1 | 7/2015 |
| WO | 2015099651 | A1 | 7/2015 |
| WO | 2016128088 | A1 | 8/2016 |
| WO | 2017190792 | A1 | 11/2017 |

* cited by examiner

MULTIPLE CAVITY MICROWAVE OVEN INSULATED DIVIDER

BACKGROUND OF THE INVENTION

Field of the Invention

The invention relates generally to a microwave oven having multiple cooking cavities, and more specifically to the insulated divider of a microwave oven having multiple cooking cavities.

Description of the Related Art

Traditional microwave ovens usually comprise a single cooking cavity in which a foodstuff to be cooked is placed. The number of foodstuffs that can be prepared at the same time in such traditional microwave ovens is therefore limited and inadequate for many users. For example, preparing different foodstuffs that require different cooking parameters in a single cavity microwave oven may require the time to cook them sequentially rather than concurrently because of the different cooking parameters. Out of this need, microwave ovens with multiple cooking cavities were developed. One problem is that microwaves emitted into one cavity may interfere with microwaves emitted into another cavity.

SUMMARY OF THE INVENTION

In one aspect, the invention relates to a radio frequency heating apparatus that has a cavity dividable into at least two sub-cavities, a removable partition for thermally insulating the at least two sub-cavities, a rail provided along a boundary of the cavity for supporting the removable partition, and at least one radio frequency generator configured to transmit radio frequency radiation into at least one of the at least two sub-cavities. The rail or a perimeter of the partition is corrugated with a set of grooves or ridges. The dimensions of the corrugations are selected based on the frequency of transmitted radio frequency radiation between the two sub-cavities.

DESCRIPTION OF THE PREFERRED EMBODIMENT

Figure 1:
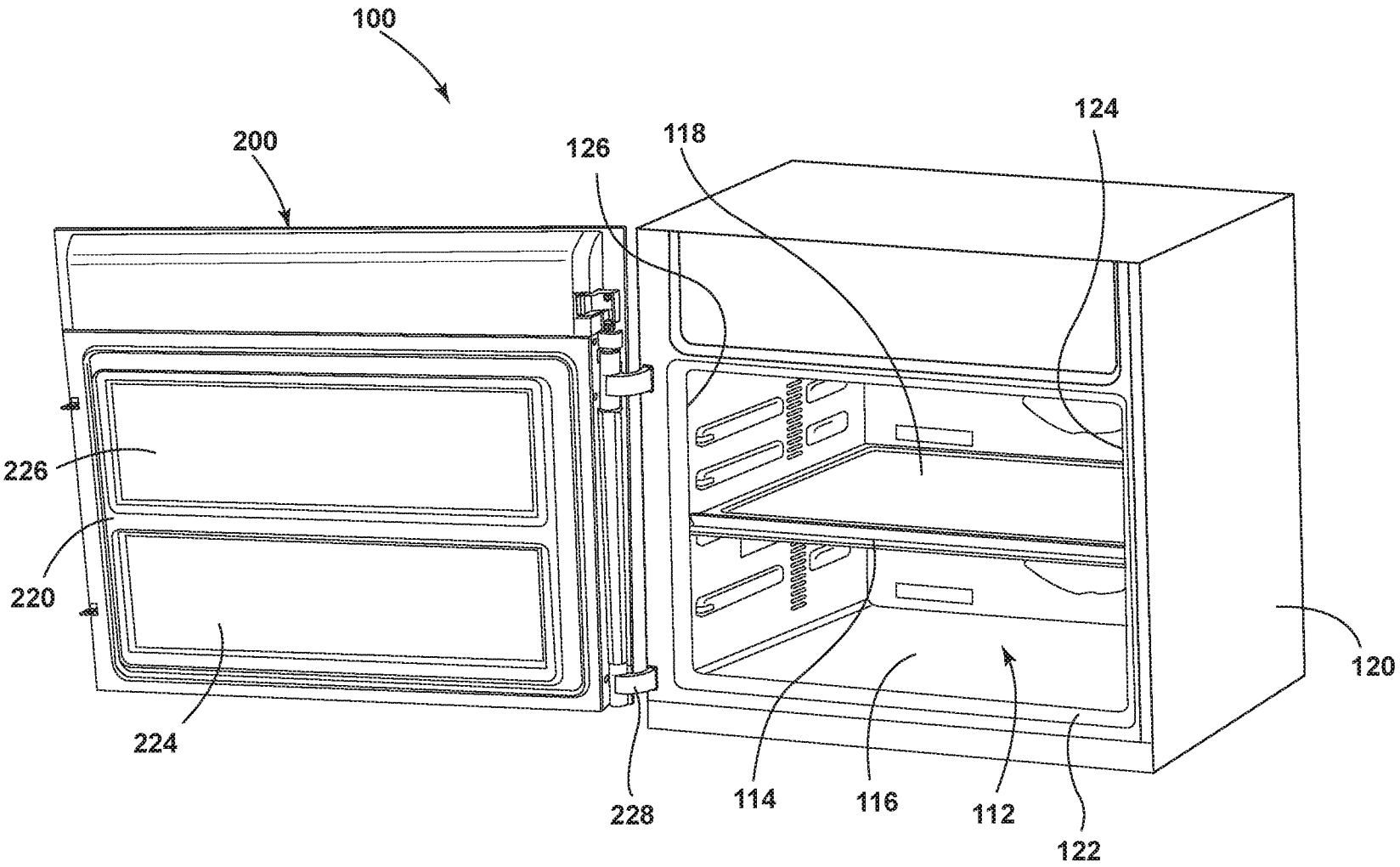
FIG. 1 is a perspective view of a microwave oven according to an embodiment of the invention.

Turning now to the drawings and to FIG. 1 in particular, there is shown a perspective view of a radio frequency heating apparatus in the form of a microwave oven 100 according to an embodiment of the invention. The microwave oven 100 includes a cabinet 120 defining a cooking cavity 112 and a removable partition 114 that extends laterally between two side walls 124, 126 of the cavity 112. The removable partition 114 divides the cooking cavity 112 into at least two sub-cavities, illustrated herein as a first sub-cavity 116 and a second sub-cavity 118. The removable partition 114 is supported by lateral rails 128, shown in FIG. 2 as attached to and protruding from the side walls 124, 126 of the cavity 112. While the illustrations herein show two sub-cavities 116, 118, it is also contemplated that the cooking cavity 112 of the microwave oven 100 could be divided into any suitable number of sub-cavities, each sub-cavity being defined by a suitable arrangement of partitions 114. Microwave energy may be selectively introduced to the first and second sub-cavities 116, 118 through at least first and second wave guides (not shown) corresponding, respectively, to the first and second sub-cavities 116, 118. Each wave guide may be supplied microwaves from a separate microwave generator including but not limited to a magnetron or a solid state radio frequency (RF) device to independently cook foodstuffs located in the two sub-cavities 116, 118. Furthermore, the electric field of the supplied microwaves can be perpendicular to the upper surface of the partition 114.

The microwave oven 100 further includes a door 200. The door 200 is provided with a choke frame 220 which encompasses a first pane of glass 224 and a second pane of glass 226 which correspond, respectively, to the first and second sub-cavities 116, 118. The first and second panes of glass 224, 226 are constructed in such a way, that they are optically transparent but not transparent to microwaves. Furthermore, the first and second panes of glass 224, 226 are separated by the choke frame 220. A hinge 228 mounted to one side of the door 200 and to the cabinet 120 pivotally connects the door 200 to the cabinet 120.

The hinge 228 allows the door 200 to pivotally move between a first open position, best seen in FIG. 1, for simultaneous access to the first and second sub-cavities 116, 118 and a second closed position (not shown) for preventing simultaneous access to the first and second sub-cavities 116, 118. When the door 200 is in the second position, the choke frame 220, and particularly the area of the choke frame 220 between the first and second panes of glass 224, 226 is in communication with the removable partition 114 in such a manner so as to attenuate microwave transmission between the first and second sub-cavities 116, 118. Furthermore, the choke frame 220 is also is in communication with the cooking cavity aperture perimeter 122 in such a manner so as to attenuate microwave transmission between the cooking cavity 112 and the door 200. In the case that there are more than two sub-cavities 116, 118 within the microwave oven 100, the choke frame 220 can be designed in such a way that it contacts all of the partitions 114 necessary to separate into the desired number of sub-cavities. Further details of the structure of the door 200 and choke frame 220 that may be used in the embodiment are disclosed in International Publication No. WO 2015/099648, published Jul. 2, 2015, which is incorporated herein by reference in its entirety.

According to one embodiment, the removable partition 114 may be arranged at half of the height of the cooking cavity 112, thereby enabling the division of the cooking cavity into the two sub-cavities 116, 118 essentially identical in size (or volume). However, according to another embodiment, the partition 114 may be arranged such that the cooking cavity 112 may be divided in different manners (e.g. at one third or two third of the height or, in other cases, at one fourth or three fourths of the height), thereby resulting in sub-cavities 116, 118 of different sizes/volumes.

Figure 2:
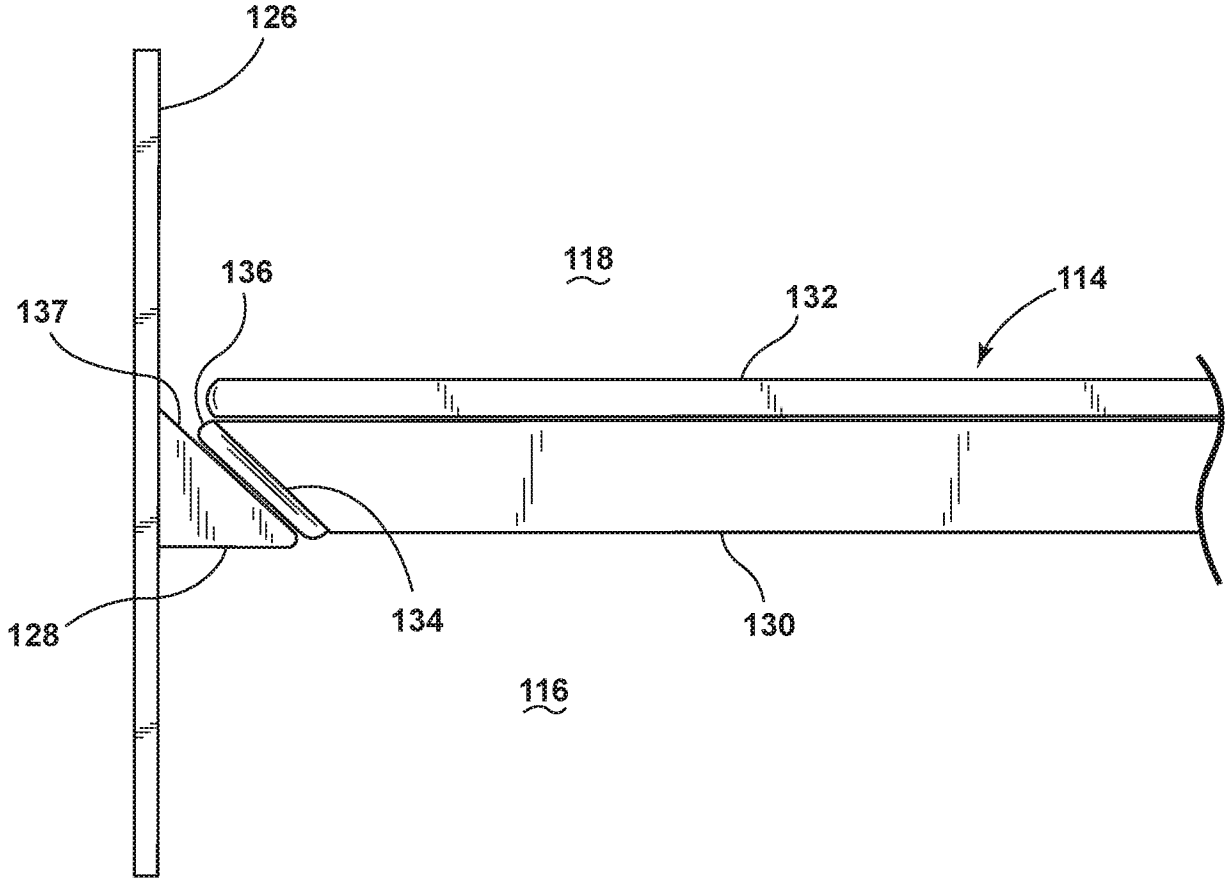
FIG. 2 is an enlarged front view of a partition for use in the microwave oven of FIG. 1 according to an embodiment of the invention.

FIG. 2 shows an enlarged front view of the removable partition 114 positioned within the microwave oven 100 according to an embodiment of the invention. The removable partition 114 is constructed in such a way that it attenuates the transmission of microwaves between the first and second sub-cavities 116, 118. The removable partition 114 may have a lower layer 130 that is a thermally insulating layer, as well as a dielectric upper layer 132, where the lower and upper layers 130, 132 are separated by an air gap. The air gap between the lower and upper layers 130, 132 increases thermal attenuation. The dielectric upper layer 132 is supported by the lower layer 130 and is suitable for cooking a foodstuff placed directly on the upper layer 132. By spacing the upper layer 132 a suitable distance away from the lower layer 130, which is not transparent to microwaves, efficient microwave cooking of foodstuff placed directly on the upper layer 132 can be achieved. One example of a suitable structural lower layer 130 for a removable partition 114 is disclosed in U.S. Patent Application No. 2013/0153570, published Jun. 20, 2013, which is incorporated herein by reference in its entirety. It is contemplated herein that the lower layer 130 may essentially form a trapezoidal box with rectangular top and bottom surfaces and side in the form of sloped surfaces 134 that angle inwardly, away from the side wall 126 of the cooking cavity 112, from the top surface to the bottom surface of the lower layer 130. It is illustrated herein that the angle of the sloped surfaces 134 of the lower layer 130 are roughly 45°, but any suitable angle that allows the removable partition 114 to stay in place, for example between 5° and 85°, is also considered.

On the sloped surfaces 134 of the lower layer 130, along the perimeter of the partition 114, are provided a set of grooves or ridges 136. In an exemplary embodiment, the set of ridges 136 is provided as a series of semi-circular corrugations protruding out from the sloped surface 134 of the lower layer 130 of the removable partition 114 and protruding towards the side wall 126 of the cooking cavity 112. In an exemplary embodiment, the lower layer 130 and the corrugated ridges 136 are formed of a single, common material. Non-limiting examples of suitable materials for the lower layer 130 of the partition 114 include aluminum or sheet steel. It is contemplated that the upper layer 132 of the partition 114 is formed of a type of glass, including, but not limited to, borosilicate. The lower and upper layers 130, 132 can be attached to each other by any suitable method, including, but not limited to, gluing the lower and upper layers 130, 132 to one another in such a way that the air gap is sufficiently maintained.

The removable partition 114 is supported by a rail 128 that is attached to the side wall 126 of the cooking cavity 112. The rail 128 protrudes from the boundary or side wall 126 of the cooking cavity 112 such that a sloped or angled surface 137 of the rail 128 angles outwardly from the side wall 126 from the topmost part to the lowermost part of the rail 128, and the angled surface 137 of the rail 128 is sloped relative to the boundary of the cavity 112. The angle of the angled surface 137 of the rail 128 as it protrudes from the side wall 126 of the cooking cavity 112 is the same as the angle of the sloped surface 134 of the lower layer 130 of the partition 114 as it angles away from the side wall 126 of the cooking cavity 112, such that when the removable partition 114 is laid on and supported by the angled surface 137 of the rail 128, the two surfaces can contact and complement one another. The angled surface 137 of the rail 128 is illustrated herein as being provided with a set of grooves or ridges 138 in a complementary pattern to the grooves or ridges on the sloped surface 134 of the lower layer 130 of the partition 114, such that the ridges 136, 138 on one of the surfaces are received in the grooves or ridges 136, 138 of the complementary surface. It is also contemplated that the angled surface 137 of the rail 128 could be completely smooth or flat and have no grooves or ridges 138. Furthermore, it is also possible that the angled surface 137 of the rail 128 could have protruding ridges 138 and the sloped surface 134 of the lower layer 130 of the partition 114 could have complementary inwardly protruding ridges 136, in the opposite configuration from what is illustrated herein. Further, it is contemplated that the sloped surface 134 could be completely smooth or flat and have no grooves or ridges 136, while the angled surface 137 of the rail 128 has protruding ridges 138. It is contemplated that the rail 128 is formed of the same material as the lower layer 130 of the partition 114 and the ridges 136, although any suitable material can alternatively be used.

Figure 3:
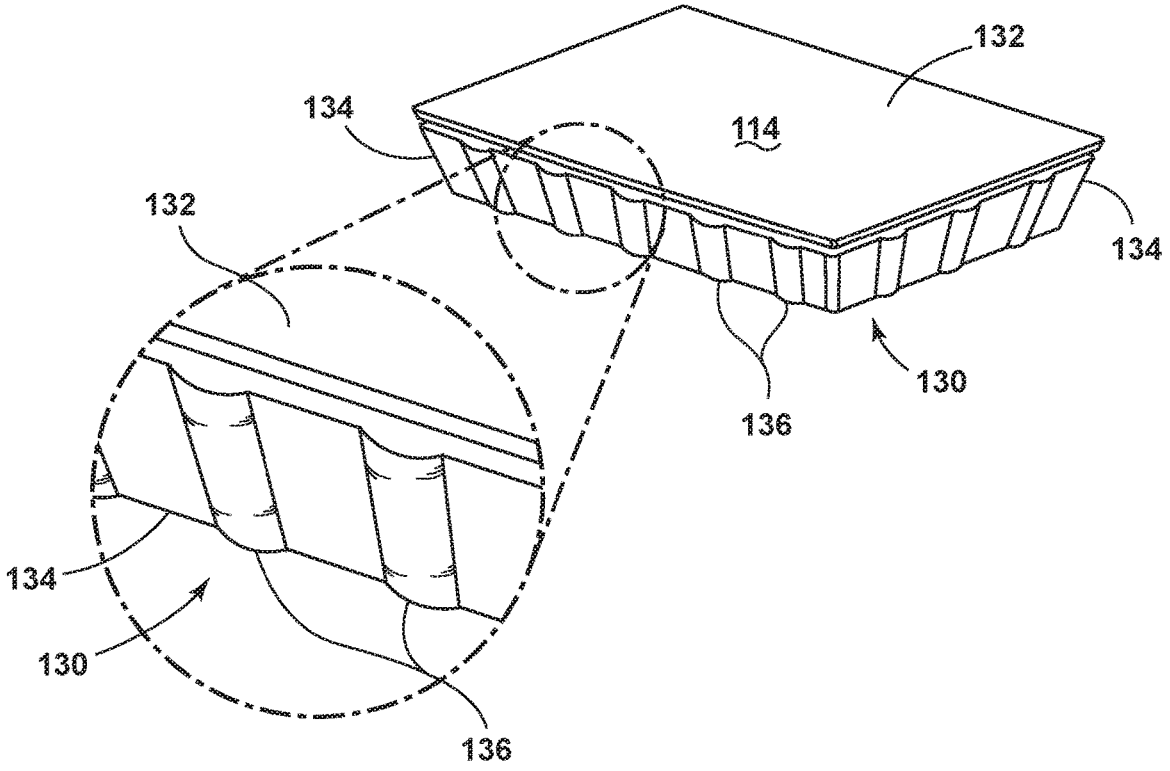
FIG. 3 is a perspective view of the partition of FIG. 2 with an enlarged view of the corrugations of the partition according to an embodiment of the invention.

FIG. 3 shows a perspective view of the removable partition 114, as well as an enlarged view of the sloped surface 134 of the partition 114. While it is illustrated here that the ridges 136 are provided on all sloped surfaces 134 of the partition 114, it is also contemplated that the ridges 136 could occupy any suitable amount of the perimeter of the partition 114. For example, the ridges 136 can be provided only on certain sides of the partition, or, within a single sloped surface 134, the ridges 136 can be provided only on a portion or multiple discrete portions of the sloped surface 134, rather than being provided along the entire length of the sloped surface 134.

Figure 4:
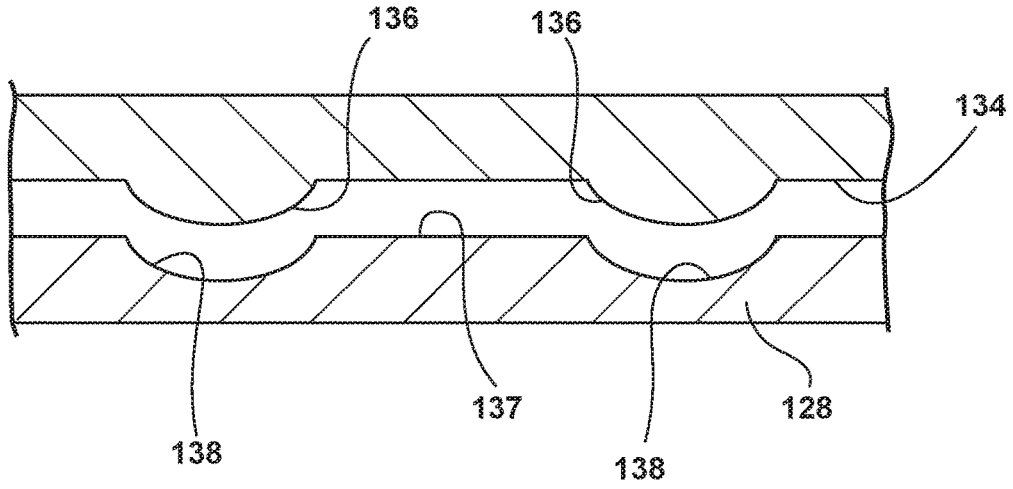
FIG. 4 is a schematic cross-sectional view of the contacting surfaces of the partition of FIGS. 2 and 3 against the rail of the microwave oven according to an embodiment of the invention.

FIG. 4 illustrates a schematic, cross-sectional view of an embodiment of the interface where the ridges 138 on the rail 128 are adjacent to and oriented so as to be facing the sloped surface 134 of the lower layer 130 of the partition 114. It is shown herein that the ridges 138 of the rail 128 and the ridges 136 of the partition 114 are arranged in such a way as to be complementary to one another. For example, the ridges 138 of the rail 128 are aligned such that each of the ridges 138 can at least partially receive each of the ridges 136 of the sloped surface 134 of the lower layer 130 of the partition 114. Conversely, the ridges 136 of the lower layer 130 of the partition 114 are aligned such that each of the ridges 136 is at least partially received within, and can further come into contact with, a ridge 138 of the angled surface 137 of the rail 128. Having this complementarity of profile between the rail 128 and the partition 114 allows for a plurality of potential contact points to create a reliable electrical connection between the rail 128 and the partition 114 in order to optimize and maximize the thermal attenuation between the two sub-cavities 116, 118, as well as ensuring that the partition 114 stays in the desired position. The complementary arrangement of the ridges 138 of the rail 128 and the ridges 136 of the lower layer 130 of the partition 114 also allows for thermal expansion of the partition 114 during cooking processes. While the rail 128 and the lower layer 130 of the partition 114 are illustrated herein as being spaced apart from one another in order to easily view the complementarity of the two separate components, it is understood that, when the partition 114 is in its position and being supported by the rail 128, the sloped surface 134 of the lower layer 130 of the partition 114 and the angled surface 137 of the rail 128 can come into physical contact with one another. During the course of thermal expansion of the partition 114 during cooking processes, the partition 114 is allowed to move slightly vertically along the angled surface 137 of the rail 128 in order to accommodate the expanded size of the partition 114. It is also contemplated that the ridges 136 of the lower layer 130 of the partition 114 could be slightly narrower than the ridges 138 of the rail 128 so that there is also some allowance for horizontal movement of the partition 114 during the course of thermal expansion.

Figure 5:
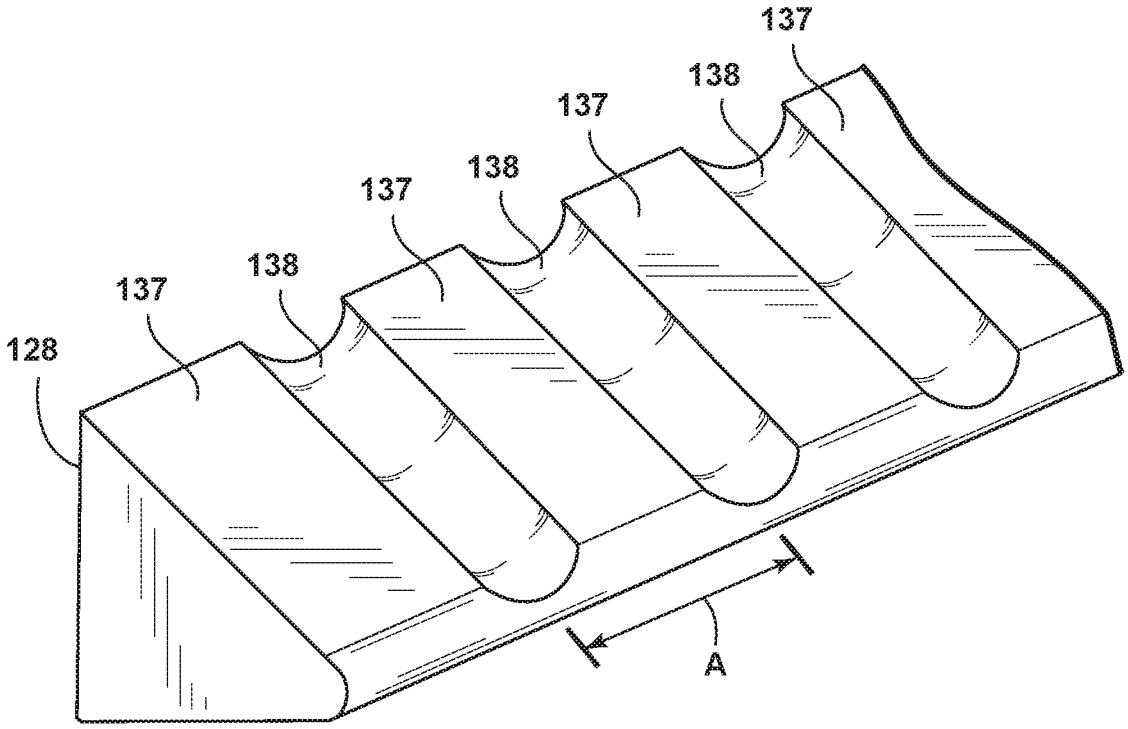
FIG. 5 is an enlarged front perspective view of the rail of the microwave oven according to an embodiment of the invention.

FIG. 5 illustrates an enlarged front perspective view of the angled surface 137 of the rail 128. The distance A between the peaks, or the pitch, of adjacent ridges 138 must be determined in such a way that attenuation of the transmission of microwaves between the two sub-cavities 116, 118 is maximized. For example, if the distance A between ridges is too large, the electrical field components will be able to pass between the sub-cavities 116, 118, reducing efficiency. Ensuring that the distance A is sufficiently small enough so that the ridges 136, 138 can act as waveguides can be accomplished by calculating the maximum value of the distance A in order for the ridges 136, 138 to act as effective waveguides. Generally the maximum width of the waveguide can be represented in the following equation:

$$A=c/2fc_{TE10}, \quad (1)$$

where, A=width of the waveguide, or distance A between the peak or pitch of adjacent ridges, c=speed of light in the vacuum, and $fc_{TE10}$=cut-off frequency, which is the upper limit of the working frequency of the microwave oven 100. In this way, the dimensions of the corrugations are selected on the basis of a cut-off frequency of transmitted radio frequency radiation between the two sub-cavities 116, 118.

It is contemplated herein that the transmitted microwave bandwidth of the microwave oven 100 is 2.5 GHz, in which case equation (1) provides a value of A=6 cm, indicating that the pitch or distance A of not more than 6 cm for a microwave oven 100 with a working frequency of 2.5 GHz is required for optimal function. Placing the ridges 136, 138 at a pitch or distance A of less than 6 cm will result in even greater attenuation of transmission of microwaves, but it is understood herein that any distance A that is less than or equal to 6 cm would be effective within the scope of the invention for a microwave oven 100 with a transmitted microwave bandwidth of 2.5 GHz. It is also contemplated that the invention can be applied with microwave ovens having transmitted microwave bandwidths of any suitable value, and that equation (1) can be used to determine a suitable distance A between ridges 136, 138 for the partition 114 and/or the rail 128. For example, the bandwidth of frequencies between 2.4 GHz and 2.5 GHz is one of several bands that make up the industrial, scientific and medical (ISM) radio bands. In another embodiment, the transmission of other microwave frequency bands is contemplated and may include non-limiting examples contained in the ISM bands defined by the frequencies: 13.553 MHz to 13.567 MHz, 26.957 MHz to 27.283 MHz, 902 MHz to 928 MHz, 5.725 GHz to 5.875 GHz and 24 GHz to 24.250 GHz.

The embodiments described above provide for a variety of benefits including the attenuation of microwave transmission between multiple cavities in a microwave oven such that foodstuffs contained in different cooking cavities may be cooked at the same time and independently of each other resulting in more even cooking and reduced cooking time.

While the invention has been specifically described in connection with certain specific embodiments thereof, it is to be understood that this is by way of illustration and not of limitation, and the scope of the appended claims should be construed as broadly as the prior art will permit.

What is claimed is:

1. A radio frequency heating apparatus comprising:
a cavity dividable into at least two sub-cavities;
a removable partition for thermally insulating the at least two sub-cavities;
a rail provided along a boundary of the cavity for supporting the removable partition; and
at least one radio frequency generator configured to transmit radio frequency radiation into at least one of the at least two sub-cavities, wherein:
one of the rail and a perimeter of the partition being corrugated with a set of grooves or ridges, and
the dimensions of the corrugations are selected based on the frequency of transmitted radio frequency radiation between the two sub-cavities.

2. The radio frequency heating apparatus of claim 1 wherein the rail has a sloped surface relative to the boundary of the cavity and the set of grooves or ridges is on the sloped surface.

3. The radio frequency heating apparatus of claim 2 wherein the perimeter of the partition has a sloped surface at the same angle as the sloped surface of the rail and the set of grooves or ridges on the partition are on the sloped surface.

4. The radio frequency heating apparatus of claim 3 wherein the ridges are on a sloped surface of the partition and the grooves are on the sloped surface of the rail and the ridges are received in the grooves.

5. The radio frequency heating apparatus of claim 2 wherein the angle of the sloped surface relative to the boundary of the cavity is in a range of 5 degrees to 85 degrees.

6. The radio frequency heating apparatus of claim 1 wherein the perimeter of the partition and the rail are composed of the same material.

7. The radio frequency heating apparatus of claim 1 wherein the dimensions include a pitch of the corrugations selected on the basis of a cut-off frequency.

8. The radio frequency heating apparatus of claim 7 wherein the pitch of the grooves or ridges is not more than 6 cm for a microwave oven with a working frequency of 2.5 GHz.

9. The radio frequency heating apparatus of claim 1 wherein the radio frequency generator is positioned to generate an electric field perpendicular to an upper surface of the partition.

10. The radio frequency heating apparatus of claim 1 wherein there is a space between the perimeter of the partition and the boundary of the cavity to allow thermal expansion of the partition.

11. The radio frequency heating apparatus of claim 1 wherein the rail is corrugated with a set of grooves or ridges and the perimeter of the partition is corrugated with a set of grooves or ridges complementary to the grooves or ridges of the rail.

* * * * *